US008932012B2

(12) United States Patent
Wlasowski

(10) Patent No.: US 8,932,012 B2
(45) Date of Patent: Jan. 13, 2015

(54) REDUCED MONOBLOC MULTISTAGE DRUM OF AXIAL COMPRESSOR

(75) Inventor: Michel Wlasowski, Verviers (BE)

(73) Assignee: Techspace Aero S.A. (BE)

( * ) Notice: Subject to any disclaimer, the term of this patent is extended or adjusted under 35 U.S.C. 154(b) by 799 days.

(21) Appl. No.: 13/045,115

(22) Filed: Mar. 10, 2011

(65) Prior Publication Data

US 2011/0223013 A1 Sep. 15, 2011

(30) Foreign Application Priority Data

Mar. 12, 2010 (EP) ..... 10156427

(51) Int. Cl.

| | |
|---|---|
| ***F04D 29/54*** | (2006.01) |
| ***F01D 5/34*** | (2006.01) |
| ***F01D 5/06*** | (2006.01) |
| ***F01D 5/30*** | (2006.01) |
| ***F04D 29/053*** | (2006.01) |
| ***F04D 29/32*** | (2006.01) |

(52) U.S. Cl.

CPC *F01D 5/34* (2013.01); *F01D 5/063* (2013.01); *F01D 5/3061* (2013.01); *F04D 29/053* (2013.01); *F04D 29/321* (2013.01); *F04D 29/329* (2013.01)

USPC ..... 415/199.4

(58) Field of Classification Search

CPC ..... F01D 5/06; F01D 5/063; F01D 5/3061

USPC ..... 415/198.1, 199.4, 199.5; 416/234, 416/244 R, 223 A, 204 A

See application file for complete search history.

(56) References Cited

U.S. PATENT DOCUMENTS

| | | | | | |
|---|---|---|---|---|---|
| 4,201,513 | A * | 5/1980 | Sales | 416/2 |
| 4,784,572 | A * | 11/1988 | Novotny et al. | 416/213 R |
| 5,007,800 | A * | 4/1991 | Hacault et al. | 416/220 R |
| 5,556,257 | A * | 9/1996 | Foster et al. | 416/241 R |
| 6,077,002 | A * | 6/2000 | Lowe | 409/132 |
| 6,969,239 | B2 * | 11/2005 | Grant et al. | 416/220 R |
| 2003/0223873 | A1 | 12/2003 | Carrier | |
| 2008/0131271 | A1 * | 6/2008 | Wood et al. | 415/191 |
| 2010/0158690 | A1 * | 6/2010 | Cortequisse et al. | 416/213 R |

FOREIGN PATENT DOCUMENTS

| | | | |
|---|---|---|---|
| EP | 1319842 | A1 | 6/2003 |
| EP | 2204541 | A1 | 7/2010 |
| GB | 2059819 | A | 4/1981 |
| WO | 2006/110125 | A2 | 10/2006 |

OTHER PUBLICATIONS

Search Report dated Jun. 28, 2010 for EP 10156427.

* cited by examiner

*Primary Examiner* — Edward Look
*Assistant Examiner* — Danielle M Christensen
(74) *Attorney, Agent, or Firm* — James E. Walton; Richard G. Eldredge

(57) ABSTRACT

An axial turbomachine compressor drum rotor stage includes an axis of rotation, a wall generally symmetrical in revolution about the axis of rotation. The wall forms a hollow body and includes a veil and an annular area integrally formed with the veil for supporting a row of vanes. The annular area includes a central part raised in relation to that of the veil.

19 Claims, 2 Drawing Sheets

REDUCED MONOBLOC MULTISTAGE DRUM OF AXIAL COMPRESSOR

This application claims priority under 35 U.S.C. §119 to European Patent Application No. 10156427, filed 12 Mar. 2010, which is incorporated herein by reference for all purposes.

BACKGROUND

1. Field of the Application

The present application relates to an axial turbomachine compressor drum, more particularly with a rotor stage of such a compressor, knowing that the drum can be composed of an assembly of several parts corresponding to different rotor stages; and more particularly still, with construction measurements of an axial turbomachine compressor drum, these measurements being intended in particular to reduce the drum.

2. Description of Related Art

In general, a compressor drum is a generally symmetrical hollow body in revolution in relation to its axis of rotation, which corresponds to the axis of the turbomachine. The hollow body has a general oval or ogive shape according to the form of the flow. Several rows of vanes are fixed on the drum so as to form different rotor stages, knowing that each rotor stage cooperates with a stator stage composed of a row of stator vanes, each pair of rotor and stator stages thus forming a compression stage of the compressor.

The centrifugal stresses exerted by the rotor vanes on the drum are very high, in particular when the drum is of large diameter and/or of high rotation speed. It is a constant worry for the designers of compressors to ensure a satisfactory mechanical resistance of the drum and vanes while taking care to reduce the drum to the maximum.

A traditional design is notably revealed in U.S. Pat. No. 4,784,572. The drum is composed of a generally smooth veil, except for the sealing elements intended to cooperate with the abradable material of the stator ferrules. It is equipped with reinforcements on its interior face on the level of the rotor vanes. These reinforcements form an integral part of the drum and are in the form of internal ribs of which the thickness is greater on the level of their ends directed towards the interior of the drum. These reinforcements are commonly called "leeks" because of their form. These reinforcements appreciably weigh down the drum because of their massiveness. The latter is the result of an optimum between two tendencies, namely, that of adding material in order to increase the stiffness of the drum and that of limiting the addition of material on the drum because of the centrifugal forces and knowing that this addition of material is all the more penalizing as the material is farther away from the axis of rotation. The rotor vanes are equipped with a series of circular ribs intended to be diffusion welded on the exterior surface of the veil of the drum. These ribs share in the stiffness of the drum. They also make it possible to level the rotor vanes with the stator vanes. The construction proposed in this document is interesting from a point of view of stiffness but imposes, however, a significant massiveness which is penalizing notably for the weight of the compressor in itself.

Patent document WBC 2-059-819 A reveals a compressor drum and tries to propose a reduced drum construction. The drum consists primarily of a series of sections assembled by diffusion. The drum comprises a veil equipped with internal ribs on the right of the sites of the veil intended to receive the rotor vanes. The veil comprises on its exterior surface a pair of ribs with each section intended to receive a row of vanes. This pair of ribs forms a U-section receptacle intended to receive the root of a vane especially designed to cooperate with this receptacle. Fixing is done by insertion of a pin or stitches through the U-shaped wings and the wings of the vane root. This construction certainly provides a favorable rigidity, but it imposes certain geometrical tolerances on the level of the jointing of the vane root and the receptacle as well as a significant mass, notably because of the ribs and the connection pin.

European Patent Application No. 08172923.0, filed by the filer of this application, reveals a reduced compressor drum comprising, in addition to the veil, a series of sections intended to receive, each, a row of rotor vanes, these sections being elevated in relation to the veil. The exterior surface of these sections delimiting the fluid stream is equipped with a series of openings, each of these holes being intended to receive a vane platform. The platform is then welded to the wall. These holes extend longitudinally on nearly the totality of the surface delimiting the aerodynamic fluid stream. These holes bored in the wall section are unfavourable, because they partially weaken it.

Although great strides have been made in the area of axial compressors, many shortcomings remain.

DETAILED DESCRIPTION OF THE PREFERRED EMBODIMENT

Figure 1:
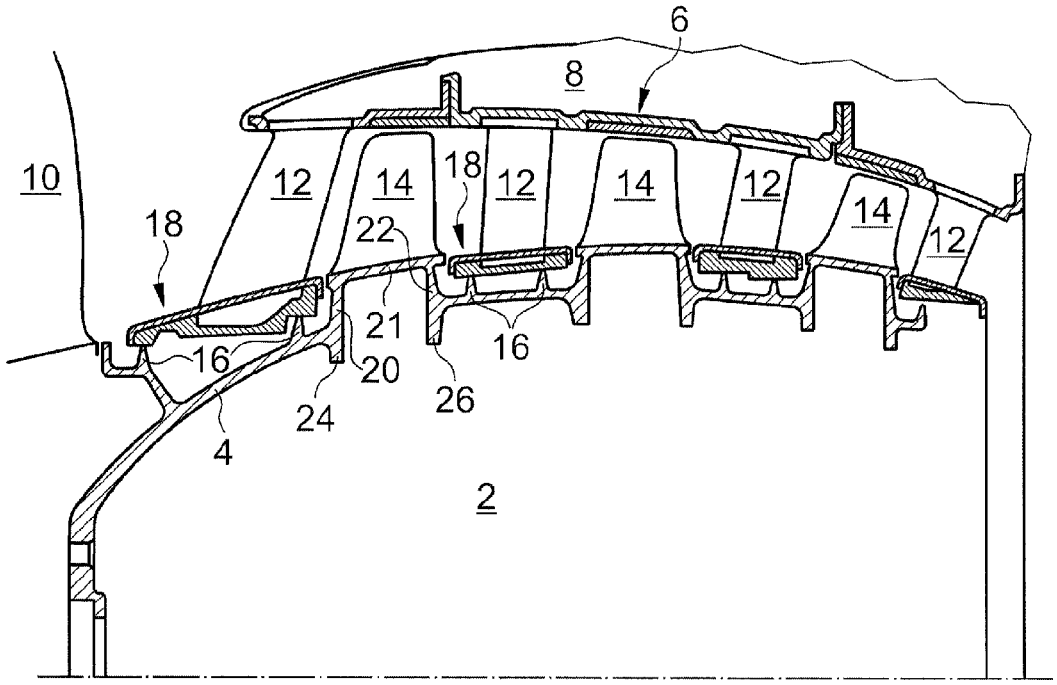
FIG. 1 is a partial cross-section view of a compressor comprising a drum with several rotor stages in conformity with the present application.

The present application aims to propose a drum rotor stage or a drum alleviating at least one of the above-mentioned known disadvantages, more particularly the present application aims to propose a reduced drum.

The present application discloses an axial turbomachine compressor drum rotor stage, the aforesaid compressor being intended to be crossed by a fluid stream in a direction generally oriented according to the axis of rotation, the rotor stage comprising a generally symmetrical wall in revolution in relation to the axis of rotation and forming a hollow body, the aforesaid wall comprising a veil and an annular area intended to support a row of vanes and integrally formed with the veil; each of the aforesaid vanes having a leading edge and a trailing edge; remarkable in that the aforesaid annular area comprises a central part raised in relation to the aforesaid veil, whose exterior surface delimits the fluid stream between the vanes, is all in one block, and is integrally formed on the circumference of the aforesaid annular area from an upstream edge of the aforesaid central part to the leading edge of the row of vanes and/or from a downstream edge of the aforesaid central part to the trailing edge of the row of vanes.

This construction makes it possible to obtain a stiffened and reduced drum. Indeed, the fact of raising the support zone of the vanes creates a locking shoulder or half-box on the level of the wall under the vane row, i.e., exactly where the stresses are the greatest. Moreover, the fact of providing a continuous surface on the level of the central part delimiting the fluid stream avoids weakening the locking shoulder thus created. In comparison with the state of the art, this construction replaces the traditional fasteners like broachings and cells, as well as massive "leeks," by a particular form of the wall on the level of the area intended to support the vanes. The interior surface of the locking shoulder or half-box is preferably free of rib, for example of the "leek" type being used only as reinforcement and adding massiveness. The vanes can be integrally formed with the rotor or even be welded onto the surface in question. Alternatively, a bottom part of the vanes can be integrally formed with the rotor, the remaining part of the vanes being then welded at this part.

The characteristics, according to which the central part is all in one block and integrally formed on the circumference of the aforesaid annular area from an upstream edge of the aforesaid central part to the leading edge of the row of vanes and/or from a downstream edge of the aforesaid central part to the trailing edge of the row of vanes, are certainly interesting but not essential.

According to one advantageous mode of the present application, the exterior surface of the central part of the annular area is generally smooth, preferably generally cylindrical, conical or of bulging form over the length of the aforesaid surface according to the axis of rotation.

A similar construction of the exterior surface of the central part has the advantage of guaranteeing a good aerodynamics.

According to another advantageous mode of the present application, at least one part, preferably the totality, of each vane is integrally formed with the annular area. Alternatively, the vanes can be welded to their base in the annular area. Various configurations of connection by welding are possible, with or without platform integrally formed with the vane.

According to still another advantageous mode of the present application, the annular area comprises at least a stiffener part generally perpendicular to the axis of rotation or inclined, preferably at an average angle of over 40° to the axis of rotation, connecting the central part to the veil. This stiffener can be a simple rib issuing from the veil and joining the support area. According to various dimensioning parameters, it is possible only to provide a single central stiffener part for a row of vanes, ensuring the connection between the veil and the annular area. In this case, the stiffener part could have a rib form generally perpendicular to the axis of rotation, and the annular area would have a band form. The veil would be free of stiffener on its inner surface to the right of the stiffener.

According to still another advantageous mode of the present application, the annular area comprises an upstream stiffener part connecting the central part to the veil upstream and a downstream stiffener part connecting the central part to the veil downstream. The presence of two stiffeners ensuring the connection of the central part to the veil ensures an optimal stability of the annular support area of the vanes.

According to still another advantageous mode of the present application, the or at least one of the stiffener parts is generally perpendicular to the axis of rotation or inclined at an average angle of over 40° to the axis of rotation, preferably at an average angle of over 50°. The inclination of one or both stiffener parts makes it possible to modify the longitudinal stiffness of the drum and, therefore, the longitudinal dynamics of the drum. This measure can thus make it possible to control the vibratory modes in relation to the functional play between the rotor and stator elements.

According to still another advantageous mode of the present application, the interior surface of the central part and parts upstream and downstream of the annular area form an open annular cavity towards the interior of the hollow body of the rotor stage. This measure defines an optimal form of locking shoulder ensuring a reinforcement while minimizing the material contribution.

According to still another advantageous mode of the present application, the section of the annular area in a plane passing through the axis of rotation has a profile of general U-shape whose opening is directed towards the axis of rotation.

According to still another advantageous mode of the present application, the or at least one of the stiffener parts projects from the veil towards the interior of the hollow body. These projecting parts increase in a favorable way the stiffness of the stiffener parts.

According to still another advantageous mode of the present application, the junction of the upstream stiffener part with the central part of the annular area is roughly flush, in a direction perpendicular to the axis of rotation, with the intersection of the leading edge of the row of vanes with the aforesaid central part and/or the junction of the downstream stiffener part with the central part of the aforesaid annular area is roughly flush, in a direction perpendicular to the axis of rotation, with the intersection of the trailing edge of the row of vanes with the aforesaid central part. This layout makes it possible to optimize the takeover of the stresses exerted by the vanes in rotation.

According to still another advantageous mode of the present application, the junction of the upstream and/or downstream stiffener part with the central part of the support area is set back from the upstream and/or downstream edge, respectively, of the aforesaid central part, so that the upstream and/or downstream edge of the aforesaid central part projects. The fact that the connecting parts are slightly set back from the respective edges of the central part makes it possible to limit certain stress concentrations in the vane.

According to still another advantageous mode of the present application, the junction of the upstream stiffener part with the central part of the annular area is set back downstream of the intersection of the leading edge of the row of vanes with the aforesaid central part and/or the junction of the downstream stiffener part with the central part of the aforesaid area is set back upstream of the intersection of the trailing edge of the row of vanes with the aforesaid central part.

According to still another advantageous mode of the present application, the central part extends according to the axis of rotation from the leading edge to the trailing edge of the vane row.

According to still another advantageous mode of the present application, the central part extends according to the axis of rotation, preferably exclusively, from a joint of the leading edge to a joint of the trailing edge of the vane row.

The present application also consists of an axial turbomachine compressor drum comprising at least one stage, preferably several stages, such as defined here before.

Other characteristics and advantages of the present application will be better understood using the description and the drawings.

A compressor comprising a drum or rotor according to the present application is illustrated in FIG. 1. It is a cross-section view of the rotor 2 and the stator 8. The drum 2 consists of a generally symmetrical wall 4 in rotation around the axis of rotation, the wall 4 thus forming a hollow body of oval or ogive shape. The wall 4 comprises a veil defining the general form of the drum. For reasons of simplicity of the illustration, FIG. 1 shows only the upper half of the rotor 2 and stator group, knowing that the other lower half is symmetrical to the upper half in relation to the axis of rotation. The same applies to the stator 8. The stator 8 and the rotor 2 define an annular passage for an airstream to move and compress from left to right according to the representation in FIG. 1. For this purpose, the rotor 2 comprises a blower 10 (partially represented at the extreme left of the Figure) and three parallel rows of vanes 14. These vanes 14 are rigidly fixed to the drum 2 and thus turn with it. Rows of rectifier vanes 12 are laid out between the rows of rotor vanes 14. These rectifier vanes 12 are rigidly fixed on their upper extremities to the wall 6 of the stator 8. Each row of vanes 12 constitutes a rectifier grid having the function of rectifying the fluid flow coming from the row of rotor vanes 14 directly upstream. One row of vanes of the rotor combined with one row of vanes of the stator directly downstream constitutes one stage of the compressor. In the case of FIG. 1, for example, the compressor consists of three stages. A row of stator vanes is present between the blower 10 and the first row of rotor vanes 14. This row of vanes rectifies the fluid flow generated by blower 10.

As can be seen in FIG. 1, the rectifier vanes 12 are fixed on exterior ferrules forming the wall 6 of the stator 8. The lower extremities of the vanes of each row of the stator are embedded in an interior ferrule 18, respectively. Each interior ferrule 18 is dimensioned so as to connect the vanes of the stator between them and to cooperate in a tight way with the rotor 2. In fact, each ferrule includes on its inner surface a friable material more commonly designed by the English term "abradable," which has, as its name indicates, the capacity to hollow out a path forming a labyrinth during friction with the sealing elements 16 of the veil of the rotor. These sealing elements 16 are circular ribs provided on the exterior surface of the rotor 2 in relation to the interior ferrules 18, respectively. These ribs extend in a plane generally perpendicular to the axis of rotation of the rotor and present an exterior edge in point form for being able to come into contact with the abradable material to ensure a certain impenetrability while minimizing the contact surface and thus the forces of friction.

The rotor or drum represented in FIG. 1 is monobloc, that is, its wall 4 is formed all in one block. The rotor vanes 14, at least their roots or bottom parts are also integrally formed with the wall 4. Although it is not visible in the Figure, the rotor vanes can be composed, each, of a bottom part integrally formed with the rotor and a top part which is fixed to the bottom part, preferably by any traditional connection process such as welding. The wall 4 of the rotor is out of metallic material such as, for example, titanium. It is initially shaped in a coarse way by forging operation and then machined. The wall 4 comprises a veil defining the bulging general cylindrical form or even oval or ogive, and supporting the sealing elements 6. In addition to the veil, the wall also comprises areas intended to support the rotor vanes. These areas have a particular geometry intended to optimize the stiffness of the rotor as well as its mass.

The rotor thus comprises three of these areas constructed in a similar way. The support area of the first rows of rotor vanes will thus be described in more detail, knowing that this description also applies to the other stages of the rotor.

The support area of the wall 4 is of annular form and essentially composed of two parts 20 and 22 of wall in the form of ribs generally perpendicular to the axis of rotation and a central part 21 supporting the row of vanes. The central part 21 is thus raised in relation to the neighbouring wall forming the veil. This raising in a direction generally perpendicular to the axis of rotation and oriented towards the outside of the hollow body makes it possible for the exterior surface of the central part 21 to be at the level of the interior surfaces of the ferrules neighbouring 18 delimiting the fluid stream. These interior surfaces of the ferrules are, in fact, at a distance from the veil because of the height of the sealing elements and the necessary thickness of the ferrule. The interior surfaces of the ferrules and the central parts 21 of the annular areas, which delimit the fluid stream are thus generally compensated and aligned so as to ensure a flow as least disturbed as possible.

The central part 21 of the annular support area is, in general, of generally upright or slightly curved cross-section so as to correspond to the general form of the fluid stream of the rotor. This central part has a generally annular form with the vane roots integrally formed with it. It has a length, in to a longitudinal direction, which essentially corresponds to the breadth in this direction of the vane roots with their joints. The central part 21 thus constitutes a generally annular platform for the vane row. The upstream 20 and downstream 22 lateral parts in the form of ribs connect this platform to the remainder of the veil. The annular support area of the vanes thus forms an annular cavity inside the hollow body and open towards this latter, in the direction of the axis of rotation. The section of the annular area in a plane passing through the axis of rotation generally has a "U" profile whose opening is directed towards the axis of rotation.

The junctions of the upstream 20 and downstream 22 lateral parts with the central part are such that they are at a distance from the respective extremities of the platform formed by the central part. The junction of the upstream part 20 with the central part 21 is roughly flush (perpendicular to the axis of rotation) with the leading edge of the vane, more precisely, flush with the intersection of the extension of the leading edge of the vane with the platform. The same applies to the part of wall downstream with the trailing edge of the vane. The platform formed by the central part thus presents a projecting upstream side edge and similarly a projecting downstream side edge. This construction makes it possible to optimize the takeover of the centrifugal stresses exerted by the vanes. Indeed, the massiveness of the vanes is present over all their breadth, so that the fact of providing the retention of the platform at a distance from its upstream and downstream edges makes it possible to avoid an unfavourable concentration of stresses on the level of the joint. Moreover, these construction measures arrange a certain space between the upstream edge and the veil, and similarly between the downstream edge and the veil, this space making it possible to bring closer the rows of rotor and stator vanes, respectively, which considerably reduces the total weight of the compressor.

The wall parts upstream 20 and downstream 22 of the annular area project from the veil towards the interior of the hollow body, thus forming internal ribs 24 and 26 in the hollow body. They contribute to reinforcing the rotor and have the advantage that their massiveness is somewhat set back from the veil and thus nearer the axis of rotation.

It should be noted that the vane roots do not necessarily have to be integrally formed with the rotor. Indeed, it is quite possible to envisage the smooth support area, possibly equipped with an opening to ensure or reinforce the fixing of the vanes thereafter. The vanes can, in fact, be simply welded to their roots in the support area, on the surface of the exterior surface of the central part 21. The vanes can also have at their roots a surface comparable to a fixing platform intended to be inserted in a corresponding opening of the annular area and then be welded there. In this case, this platform would ideally be of reduced size, namely, essentially centered on the vane and at a distance from the leading and trailing edges.

It is also to be noted that the rotor wall does not necessarily have to be built in one single piece. In fact, it may even be desirable to envisage several sections intended to be assembled. Such a construction makes possible a substantial gain of material to be machined, because it allows a first setting of form by forging which will be appreciably closer to the final form. The result is a reduced loss of material removed by machining as well as a reduction in the machining time.

Figure 2:
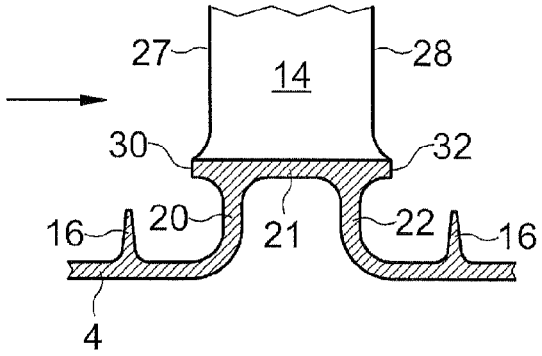
FIG. 2 is a partial cross-section view of a first rotor stage alternative in conformity with the present application.

FIG. 2 illustrates a first construction alternative of an annular rotor support area. The arrow indicates the direction of flow of the fluid. This first alternative defers from the present construction at the various stages of the rotor of FIG. 1 primarily in that the upstream 20 and downstream 22 lateral parts are connected to the veil by round-offs and thus no longer project from the veil towards the hollow body interior. The wall round-offs have the advantage of reducing the concentrations of stresses on the level of the junctions between the lateral parts and the veil.

This decrease of stress concentration makes it possible to carry out internal ribs present in the design of FIG. 1. The junctions of the upstream 20 and downstream 22 lateral wall parts, with the platform or central part 21, are at a distance from the respective upstream 30 and downstream 32 edges, and slightly set back towards the interior of the cavity formed from the perpendicularity of the leading 27 and trailing 28 edges, respectively.

Figure 3:
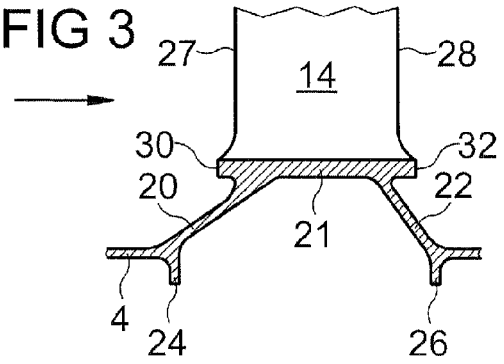
FIG. 3 is a partial cross-section view of a second rotor stage alternative in conformity with the present application.

FIG. 3 illustrates a second construction alternative of an annular support area of rotor vanes. The arrow indicates the direction of flow of the fluid. This alternative is distinguished from the construction of FIG. 1 primarily in that the upstream 20 and downstream 22 lateral wall parts are inclined in relation to a perpendicular to the axis of rotation. This inclination has the advantage of being able to control the stiffness of the drum according to its axis of rotation, while enjoying the advantages of the construction of FIG. 1. The rotor can be actually be subject to a longitudinal vibratory dynamic, because of certain vibratory modes according to this direction. The fact of inclining one or the other of the lateral wall parts on the level of the support area makes it possible to preserve a sufficient longitudinal stiffness. This measure is all the more useful as the mechanical play between the upstream 30 or downstream 32 edge and the adjacent edge of the internal ferrule is reduced.

Figure 4:
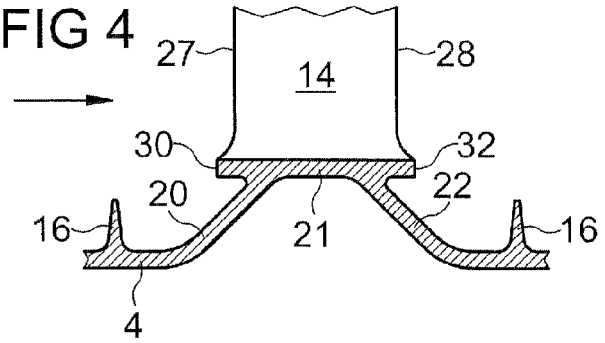
FIG. 4 is a partial cross-section view of a third rotor stage alternative in conformity with the present application.

FIG. 4 is a third construction alternative of an annular support area of rotor vanes. The arrow indicates the direction of flow of the fluid. It is primarily a combination of the designs of FIGS. 2 and 3, namely with the characteristic that the upstream 20 and downstream 22 lateral parts are inclined as in FIG. 3 and are connected to the veil by rounded sections as in FIG. 2. This construction consequently has the combined advantages of the embodiments of FIGS. 2 and 3.

Figure 5:
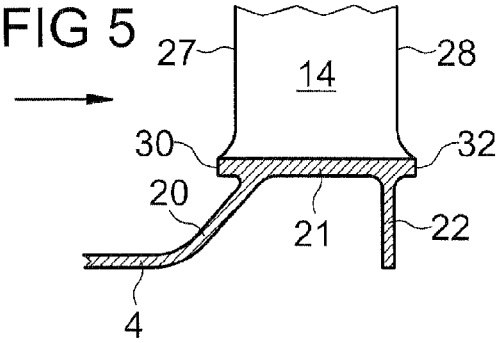
FIG. 5 is a partial cross-section view of a fourth rotor stage alternative in conformity with the present application.

FIG. 5 illustrates a fourth construction alternative of an annular support area of rotor vanes. The arrow indicates the direction of flow of the fluid. This alternative corresponds to the construction of FIG. 4 with, however, the difference that one of the lateral parts, for example, the downstream part 22, is generally perpendicular to the axis of rotation and not inclined. In this precise case, the downstream lateral part 22 does not have any connection to the veil. This construction can be favorable for the last vane row. It makes it possible to maintain a rigidity with significant radial stresses while ensuring a necessary longitudinal rigidity.

Figure 6:
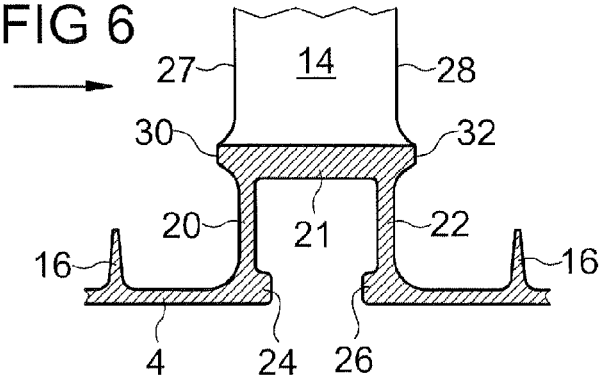
FIG. 6 is a partial cross-section view of a fifth rotor stage alternative in conformity with the present application.

FIG. 6 illustrates a fifth construction alternative of a support area of rotor vanes. The arrow indicates the direction of flow of the fluid. This alternative is connected to the constructions illustrated in FIG. 1 where, however, the internal ribs 24 and 26 no longer project towards the axis of rotation but now one towards the other, i.e., in a longitudinal direction.

It is important to note that the various alternative constructions of the support areas of rotor vanes are purely illustrative and not limitative. There are thus other similar constructions in conformity with the invention.

Moreover, it should be noted that each rotor stage will be able to have a construction of the annular support area of the vanes which will be specific for it according to various dimensioning parameters.

In the description of the invention which was given above, the wall constituting the veil and the annular support area of a rotor stage is envisaged all in one block. Although this embodiment seems to be the most practical to date, it should be noted that the present application could allow for the wall of the rotor stage to be composed of several wall sections assembled, for example, by welding.

It is apparent that an invention with significant advantages has been described and illustrated. The particular embodiments disclosed above are illustrative only, as the invention may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. Although the present application is shown in a limited number of forms, it is not limited to just these forms, but is amenable to various changes and modifications without departing from the spirit thereof.

I claim:

1. An axial turbomachine compressor drum rotor stage, comprising:

an axis of rotation;

a wall generally symmetrical in revolution about the axis of rotation, the wall forming a hollow body and comprising:

a veil; and an annular area integrally formed with the veil for supporting a row of vanes, the annular area including a central part raised in relation to that of the veil;

wherein the exterior surface of the central part delimits the fluid stream between the vanes;

wherein the annular area is all in one block along the circumference of the annular area from an upstream edge of the central part to a leading edge of the row of vanes, and from a downstream edge of the central part to the trailing edge of the row of vanes; and wherein the annular area comprises an upstream stiffener part connecting the central part to the veil upstream and a downstream stiffener part connecting the central part to the veil downstream.

2. The rotor stage according to claim 1, wherein the exterior surface of the central part of the annular area is generally cylindrical relative to the axis of rotation.

3. The rotor stage according to claim 1, wherein the exterior surface of the central part of the annular area is generally conical relative to the axis of rotation.

4. The rotor stage according to claim 1, wherein the exterior surface of the central part of the annular area bulges relative to the axis of rotation.

5. The rotor stage according to claim 1, wherein at least one part of each vane is integrally formed with the annular area.

6. The rotor stage according to claim 1, wherein the annular area comprises:

a stiffener part generally perpendicular to the axis of rotation for connecting the central part to the veil.

7. The rotor stage according to claim 1, wherein the annular area comprises:

a stiffener part generally inclined relative to the perpendicular to the axis of rotation for connecting the central part to the veil.

8. The rotor stage according to claim 7, wherein the average angle of incline is over 40°.

9. The rotor stage according to claim 1, wherein at least one of the stiffener parts is generally perpendicular to the axis of rotation.

10. The rotor stage according to claim 1, wherein at least one of the stiffener parts is inclined relative to the perpendicular to the axis of rotation at an average angle of over 50°.

11. The rotor stage according to claim 1, wherein the interior surface of the central part, the upstream stiffener part, and the downstream stiffener part form an open annular cavity facing the interior of the hollow body.

12. The rotor stage according to claim 1, wherein the section of the annular area in a plane passing through the axis of rotation has a U-shaped profile opening in a direction toward the axis of rotation.

13. The rotor stage according to claim 1, wherein at least one of the stiffener parts projects from the veil toward the interior of the hollow body.

14. The rotor stage according to claim 1, wherein the junction of the upstream stiffener part with the central part is roughly flush, in a direction perpendicular to the axis of rotation, with the intersection of the leading edge of the row of vanes with the central part; and the junction of the downstream stiffener part with the central part is roughly flush, in a direction perpendicular to the axis of rotation, with the intersection of the trailing edge of the row of vanes with the central part.

15. The rotor stage according to claim 1, wherein the junction of at least one of the upstream stiffener part and the downstream stiffener part with the central part is offset from the corresponding edge of the central part, so that the corresponding edge of the central part projects generally along the axis of rotation.

16. The rotor stage according to claim 1, wherein the junction of at least one of the upstream stiffener part and the downstream stiffener part with the central part is offset from the intersection of the corresponding edge of the row of vanes with the central part.

17. The rotor stage according to claim 1, wherein the central part extends according to the axis of rotation from the leading edge to the trailing edge of the vane row.

18. The rotor stage according to claim 1, wherein the central part extends according to the axis of rotation from a joint of the leading edge to a joint of the trailing edge of the vane row.

19. An axial turbomachine compressor drum comprising:

at least one stage comprising:

an axis of rotation;

a wall generally symmetrical in revolution about the axis of rotation, the wall forming a hollow body and comprising:

a veil; and an annular area integrally formed with the veil for supporting a row of vanes, the annular area including a central part raised in relation to that of the veil;

wherein the exterior surface of the central part delimits the fluid stream between the vanes;

wherein the annular area is all in one block along the circumference of the annular area from an upstream edge of the central part to a leading edge of the row of vanes, and from a downstream edge of the central part to the trailing edge of the row of vanes; and wherein the annular area comprises an upstream stiffener part connecting the central part to the veil upstream and a downstream stiffener part connecting the central part to the veil downstream.

* * * * *